United States Patent [19]

Goerens

[11] Patent Number: 4,724,664

[45] Date of Patent: Feb. 16, 1988

[54] METHOD AND APPARATUS FOR PRODUCING A FLOCKED THREAD OR YARN, AND FLOCKED THREAD OR YARN MANUFACTURED THEREBY

[75] Inventor: Robert L. Goerens, Esch/Alzette, Luxembourg

[73] Assignee: Uniroyal Englebert Textilcord S.A., Steinfort, Luxembourg

[21] Appl. No.: 789,062

[22] Filed: Oct. 18, 1985

[30] Foreign Application Priority Data

Oct. 20, 1984 [DE] Fed. Rep. of Germany ..... 3438616

[51] Int. Cl.[4] ..... D02G 3/34; D02G 3/36; B05D 1/16

[52] U.S. Cl. ..... 57/207; 57/5; 57/7; 57/206; 57/224; 57/297; 118/638; 427/25; 427/26; 427/32

[58] Field of Search ..... 57/5, 7, 6, 206–209, 57/295, 297, 224; 427/25, 26, 32; 118/638, 640

[56] References Cited

U.S. PATENT DOCUMENTS

| | | | |
|---|---|---|---|
| 2,328,577 | 9/1943 | Oglesby | 427/25 |
| 2,411,559 | 11/1946 | Sonin et al. | 57/5 X |
| 2,447,374 | 8/1948 | Smyser | 427/26 |
| 2,743,573 | 5/1956 | Hiensch | 57/5 |
| 3,104,516 | 9/1963 | Field, Jr. | 57/207 X |
| 3,439,491 | 4/1969 | Scruggs | 57/5 |
| 3,591,403 | 7/1971 | Sheehan | 427/25 |
| 3,845,611 | 11/1974 | Senturk et al. | 57/5 |
| 3,901,012 | 8/1975 | Safar | 57/5 X |

FOREIGN PATENT DOCUMENTS

| | | | |
|---|---|---|---|
| 1034942 | 7/1966 | United Kingdom | 427/26 |

*Primary Examiner*—John Petrakes
*Attorney, Agent, or Firm*—Becker & Becker, Inc.

[57] ABSTRACT

A method and apparatus for producing thread or yarn-like material by electrostatically flocking it or covering it with fibers. Grounded base or carrier threads that are provided with adhesive are moved through an electrostatic field of high voltage, where the surfaces of the carrier threads are flocked all the way around with pretreated short fibers (flock material). During the course of producing the flocked thread or yarn, selective lengths of the carrier threads are nonuniformly flocked in an irregular sequence, with the flock material, in different flock patterns.

9 Claims, 3 Drawing Figures

METHOD AND APPARATUS FOR PRODUCING A FLOCKED THREAD OR YARN, AND FLOCKED THREAD OR YARN MANUFACTURED THEREBY

BACKGROUND OF THE INVENTION

1. Field of the Invention

The present invention relates to a method and apparatus for producing thread or yarn-like material by electrostatically flocking it or covering it with fibers. Grounded base or carrier threads that are provided with adhesive are moved through an electrostatic static field of high voltage, where the surfaces of the carrier threads are flocked all the way around with supplied, pretreated short fibers (flock material). The present invention also relates to the flocked thread or yarn manufactured by such a method and with such an apparatus.

2. Description of Prior Art

Due to the uniform method of flocking and the uniform flock construction, the heretofore known flocked threads or yarns, which are processed on weaving machines, double-rib looms, knitting machines, power knitting looms, or non-woven machines, or are used for producing webs of cloth, trim, fabric, knitted material, or other textile goods, have a surface which is visually uniform. By cross-weaving or patterning of the flocked threads, this surface can be interrupted only in intentional, uniformly constructed patterns or designs, or a design can be visually produced by different colors of the individual flocked threads. The pattern of this design is preprogrammed. In this manner, for example, herringbone patterns, diamond shapes, or checkered patterns are obtained. These patterns provide smooth, uniform, or cross-woven goods.

An object of the present invention is to produce a design of flocked threads having no repeated pattern. Neither a pattern nor a design should be evident. Thus, a further object of the present invention is to achieve a satisfactory yet irregular surface pattern by flocking the carrier threads during the course of the production process.

BRIEF DESCRIPTION OF THE DRAWING

These objects, and other objects and advantages of the present invention, will appear more clearly from the following specification in conjunction with the accompanying drawing, in which.

SUMMARY OF THE INVENTION

Figure 1:
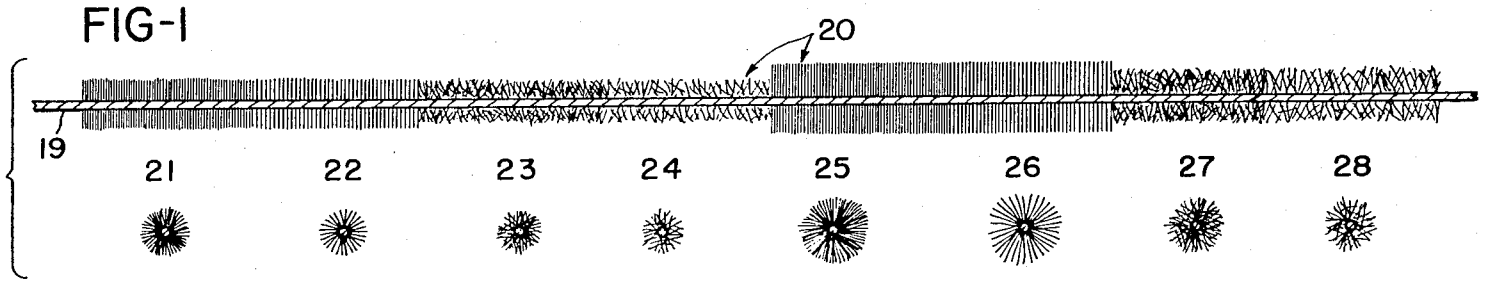
FIG. 1 shows one exemplary embodiment of a variety of different flock patterns for a flocked effect yarn.

The present invention is characterized primarily in that during the course of the flocking process, specific yet selective lengths of the carrier threads are flocked in different patterns by nonuniformly flocking the carrier threads in an irregular sequence with flock material in different flock patterns.

In this manner, flocked threads are produced which, by differing structures of the flock, are distinguished by an intentionally uncontrolled sequence of different types of flocking, and by changing spacing between the different flocked areas. The design produced hereby has neither a pattern nor a fixed design. No repeated pattern is provided. Such a uniform irregularity provides the design with a liveness and fantasy. Up to now, a design having a high flock quality and such a completely novel pattern and character could not be produced.

The nonuniform flocking can be effected freely arbitrarily during the flocking process or by controlling the parameters for the flocking (material, dosage, tension) during the course of the process. The different flock patterns are differentiated from one another by length of the fibers, density of the fibers, and orientation of the fibers, i.e. whether or not they are disposed radially, relative to the carrier thread.

The irregularities can be achieved by regulating the tension of the base or carrier thread. As a result, there is achieved either a radial flocking all the way around, or a predominantly irregular flocking all the way around, in other words, the fibers are not disposed about the thread radially relative to the surface of the thread. Furthermore, the irregularities can be achieved by regulating the high voltage of the electrodes, by means of which an optimum dense radial flocking, an irregular flocking and/or a low-density flocking is achieved. Furthermore, a deliberate irregular flock pattern can be controlled by selectively cutting in or cutting out one and/or the other of the existing dosing devices, which contain the different flock materials which are differentiated from one another in fineness, length, and color.

The inventive method makes it possible to produce a flocked thread having a multiplicity of individual, successive flock constructions with which no known product can compare with regard to force of expression and fantasy, while at the same time a high quality is maintained. The combination of the individual flock construction concerns not only the respective lengths of the sections of the base or carrier thread, but also the differing sequences in the flock thread.

Depending upon the subsequent application, or the method provided for processing the flocked thread, it is possible pursuant to the present invention to adjust the thread size in the design. The thread is preferably between 10 and 5000 meters. As a result, the further user of the flocked thread is assured that a satisfactory, irregularly ordered pattern of the fabric, knitted goods, etc. will be obtained without having to fear that a pattern will evolve.

The flock constructions in the selected sequence can be altered to desired lengths of preferably 5 cm to 7 m. As a result, the visually perceived color impressions are also altered at the same time.

Along specific yet selective lengths of sections of the flocked thread obtained, not only densely radially disposed but also irregular flocking, partially with long and partially with short flock fibers, are obtained in a sometimes dense and sometimes not so dense flock arrangement. As a result, each thus obtained flocked thread is particularly effective. In this respect a new flocked fancy or effect thread is obtained. The deliberate irregularity in construction and sequence can be achieved by flocking the threads, during production, by a series of adjustable factors. This is effected in an apparatus which essentially comprises flock transport means preferably having a plurality of supply and dosing means which contain different flock constructions; the apparatus also contains two spaced apart electrodes connected to sources of high voltage, which can be varied. A thread dispensing mechanism with a tensioning device for regulating the tensioning of the thread is also provided. The base or carrier threads are moved through this apparatus, and are preferably irregularly flocked in a controlled manner.

DESCRIPTION OF PREFERRED EMBODIMENTS

Referring now to the drawing in detail, FIG. 1 illustrates a variety of different flock or fiber construction arrangements, known as flock patterns. The carrier thread is designated by the reference numeral 19, and the flock or fibers are designated by the reference numeral 20. The following exemplary flock patterns are illustrated:

Pattern 21: A thread surface which is densely and radially flocked or covered with fibers all the way around, with the cut length of the flock being approximately 0.5 to 1 mm, and with the flock density being 100%;

Pattern 22: A thread which is radially flocked less densely, with the cut length of the flock being approximately 0.5 to 1 mm, and the flock density being approximately 85–90%;

Pattern 23: A densely, irregularly flocked thread, with a cut length of the flock of approximately 0.5 to 1 mm, and a flock density of 98–100%;

Pattern 24: A less densely, irregularly flocked thread, with a cut length of the flock of approximately 0.5 to 1 mm, and a flock density of 85–90%; In Patterns 23 and 24, the flock is not disposed at an angle of essentially 90° to the core of the thread, but rather extends in part to an angle with deviates considerably therefrom, and even at 30° to the core;

Pattern 25: A thread which is densely radially flocked all the way around, with a cut length of the flock of approximately 1 to 1.5 mm, and a flock density of 100%;

Pattern 26: A less densely radially flocked thread, with a cut length of the flock of approximately 1 to 1.5 mm, and a flock density of approximately 85–90%;

Pattern 27: A densely, irregularly flocked thread, with a cut length of the flock of approximately 1 to 1.5 mm, and a flock density of 98–100%; and Pattern 28: A less densely, irregularly flocked thread, with a cut length of the flock of approximately 1 to 1.5 mm, and a flock density of 85–90%.

The same explanation provided in connection with Pattern 24 regarding the angle of the flock applies to the Patterns 27 and 28.

Figure 2:
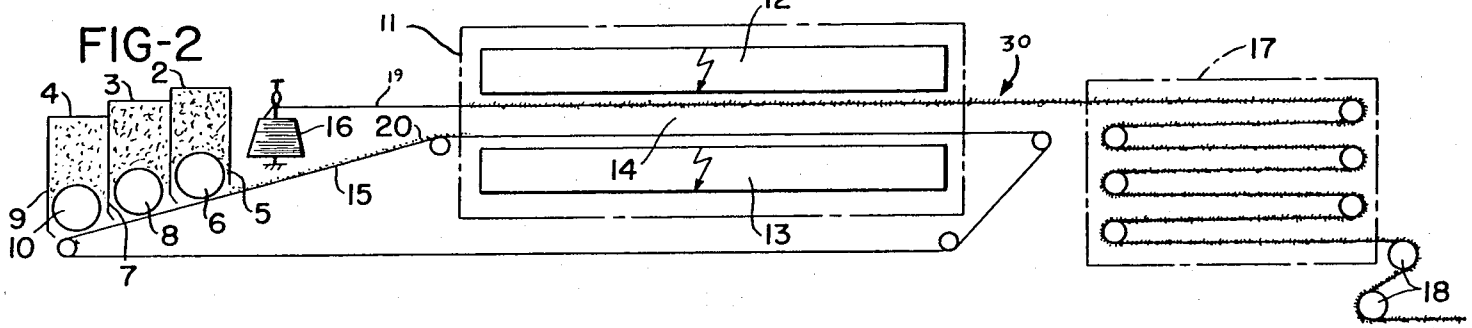
FIG. 2 schematically illustrates one embodiment of the inventive device for producing a flocked effect thread.

An exemplary, inventive apparatus for flocking or covering the thread with fibers is shown in FIG. 2. This apparatus comprises: An endless conveyer 15; flock storage means 2, 3, and 4, which are associated with the input side of the flocking chamber 11, make available different flock materials, and are formed of the containers 5, 7, and 9 and the dosing devices 6, 8, and 10; the flocking chamber 11, which contains an upper electrode 12 and a lower electrode 13 that can be connected to high voltage; the spool withdrawal frame 16; the drying means 17; and the tensioning device 18 for regulating the tension of the thread, with the tnsioning device 18 and the frame 16 forming the dispensing mechanism. The electrostatic field is designated by the reference numeral 14.

The base or carrier threads 19 are moved through the inventive apparatus, and are variously flocked with the flock or fibers 20 in the flocking chamber 11.

Figure 3:
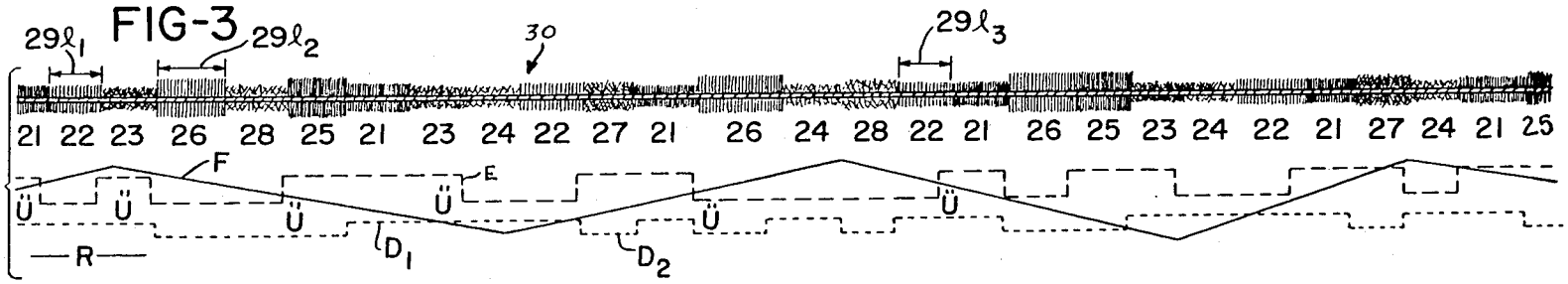
FIG. 3 shows a flocked effect thread comprised of different abutting flock patterns.

The flocked fancy or effect thread 30 illustrated in FIG. 3 comprises different flock Patterns 21–28 that have been flocked in an irregular sequence. From one flock construction to the next, the design units, in other words for the actual flocking and transition to a succeeding flocking of a different type, have time units of, for example, 0.2 meters of thread per second, a changing high voltage of, for example, 50 KV to 40 KV, changing thread tensions of, for example, 400 grams to 800 grams or to 200 or 600 grams, and changing dosages.

In connection with FIG. 3, the following symbols are used: R-Design unit, Ü- transition, overlap, E-High voltage, F -thread tension, and D-dosage, for example, $D_1$, $D_2$, etc.

As a result of the different controls/time units, with each of the individual parameters the transitions or overlaps, and the distances between the respective flock pattern constructions, differ greatly in the pertaining sections of thread length. Such flocked effect threads do not permit an undesired pattern to result when the threads are subsequently used to form fabrics or other textile goods.

Applications for the inventively flocked threads includes the upholstery industry, especially for automobile upholstery.

As shown for the exemplary flocked thread 30 of FIG. 3, the carrier thread is first flocked radialy and densely all the way around, at a thread tension F of 400 g and an electrical high voltage E of 50 KV, with flock material at a disage $D_1$ and along a thread length 29 $l_1$ with flock of short fibers in conformity with the flock Pattern 21. The carrier thread, after a first change of the electrical high voltage E to 40 KV, is then flocked less densely. No actual flock construction exists at the overlap location Ü.

There now follows a flocking with fibers pursuant to the flock Pattern 22 and a further high voltage change E to 50 KV, accompanied in the meantime by a changed thread tension F to 600 g and a thereby effected irregular flocking pursuant to the flock Pattern 23.

The dosage is thereupon changed from $D_1$ to $D_2$, accompanied by the high voltage E of 40 KV and reduced thread tension F, whereupon flocking with longer fibers yet less density occurs radially along a thread length 29 $l_2$ pursuant to the flock Pattern 26.

The sequence of flocking with different flock constructions and type of flock, with changing parameters relative to the thread tension F, the high voltage E, and the material or the dosages D thereof, continues in the illustrated sequence of flock Pattern 28, 25, etc.

The design unit R is thus achieved, for example after 1000 seconds, during continuous production of the flocked effect thread 30, and has a length of approximately 236 meters; this design unit is repeated during production of further lengths of the flocked effect thread design.

The present invention is, of course, in no way restricted to the specific disclosure of the specification and drawings, but also encompasses any modifications within the scope of the appended claims.

What I claim is:

1. In a method of producing a flocked thread or yarn by electrostatically flocking short fiber flock material onto carrier threads, and including the step of moving grounded carrier threads that are provided with adhesive through an electrostatic field of high voltage, where the surfaces of said carrier threads are flocked all the way around with supplied, pretreated short fiber flock material, the improvement including the step of:

during the course of producing said flocked thread or yarn, non-uniformly flocking specific, selective lengths of said carrier thread, in an intentionally uncontrolled irregular sequence, with said short fiber flock material, in different flock patterns by changing flock length, material, density and disposition to attain an irregular surface pattern by flocking the carrier threads to have neither any repetitive pattern nor any fixed design arrangement thereof on said carrier threads.

2. A method according to claim 1, which includes the step of effecting said nonuniform flocking of said carrier thread by controlling flock dosage, electrical field carrier voltage, and thread tension in the course of producing said flocked thread.

3. A method according to claim 2, which includes the step of using flock material having different colors.

4. A method according to claim 2, which includes the step of varying the thread tension of said carrier thread during the course of producing said flocked thread.

5. A method according to claim 2, which includes the step of varying the high voltage of said electrostatic field during the course of producing said flocked thread.

6. A method according to claim 2, which includes the steps of making several different flock materials available during the course of producing said flocked thread, and varying which of said flock materials is supplied during said production.

7. A method according to claim 6, which includes the step of varying the dosages of said flock materials during the course of producing said flocked thread.

8. A flocked thread or yarn produced from a carrier thread and flock material pursuant to claim 1, and comprising a flocked effect thread having different flock patterns in an arbitrary sequence over specific, selective lengths of said thread.

9. An apparatus for producing electrostatically flocked thread or yarn, with a grounded carrier thread that is provided with an adhesive being moved through an electrostatic field of high voltage, where the surface of said carrier thread is flocked all the way around with pretreated short fiber flock material during the course of producing said flocked thread or yarn, specific, selective lengths of said carrier thread are nonuniformly flocked in an intentionally uncontrolled irregular sequence, with said short fiber flock material, in different flock patterns; comprising:

short fiber flock storage means;

conveying means operatively associated with said flock storage means;

regulatable dosing means for supplying said short fiber flock material from said short fiber flock storage means onto said conveying means;

means forming a flocking chamber having an inlet region for receiving said carrier thread, and said conveying means with said short fiber flock material thereon; said flock storage means and said dosing means, for the purpose of permitting the production of different flock constructions of various colors, being provided in the inlet region of said flocking chamber;

two spaced-apart regulatable electrodes that are provided in said flocking chamber and are connected to a high voltage source to produce said electrostaic field;

a spool withdrawal frame for feeding said carrier thread into said flocking chamber;

a regulatable thread tensioning device operatively connected with said carrier thread; and drying means disposed downstream of said flocking chamber for receiving said flocked thread therefrom to attain an irregular surface by flocking said carrier-thread to have neither any repetitive pattern nor any fixed design arrangement thereof on said carrier thread.

* * * * *